US007044779B1

(12) United States Patent
Liu

(10) Patent No.: US 7,044,779 B1
(45) Date of Patent: May 16, 2006

(54) ELECTRONIC CONNECTOR SOCKET

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 0 days.

(21) Appl. No.: 11/157,728

(22) Filed: Jun. 21, 2005

(51) Int. Cl.
*H01R 13/60* (2006.01)

(52) U.S. Cl. ..... 439/541.5; 439/540.1; 439/620

(58) Field of Classification Search ..... 439/541.5, 439/540.1, 676, 607, 620
See application file for complete search history.

(56) References Cited

U.S. PATENT DOCUMENTS 6,174,198 B1 * 1/2001 Wu et al. ..... 439/541.5
6,835,092 B1 * 12/2004 Wan et al. ..... 439/541.5

* cited by examiner

*Primary Examiner*—Tho D. Ta
*Assistant Examiner*—Vanessa Girardi
(74) *Attorney, Agent, or Firm*—William E. Pelton, Esq.

(57) ABSTRACT

An electronic connector socket has an upper RJ-45 hole and a lower USB hole in which at least two USB sockets can be formed. When manufacturers mass-produce the electronic connector sockets, separately making USB socket modules is not necessary anymore. The time to manufacture the electronic connector sockets also can be reduced. The manufacturers are able to increase profit from making the electronic connector sockets.

8 Claims, 17 Drawing Sheets

ELECTRONIC CONNECTOR SOCKET

BACKGROUND OF THE INVENTION

1. Field of the Invention

The present invention relates to a connector socket, and more particularly to an electronic connector socket that has an RJ-45 socket and at least one USB socket.

2. Description of Related Art

RJ-45 plugs and USB plugs are widely used with computers for transmission of data. A computer needs at least one electronic connector socket with an RJ-45 socket and a USB socket.

With reference to FIGS. 16 and 17, a conventional electronic connector socket comprises a socket chassis (60), an RJ-45 socket module (63), a USB socket module (64) and a housing (70).

The socket chassis (60) has an open rear end, an upper RJ-45 socket (61), and a lower slot (62).

The RJ-45 socket module (63) has a base, a circuit board, multiple resilient contacts and multiple filters. The circuit board is mounted on the base, and the base and circuit board are mounted in the open rear end of the socket chassis (60). The resilient contacts are connected to the circuit board and extend into the upper RJ-45 socket (61). The filters are mounted on the circuit board.

The USB module (64) is mounted in the lower slot (62) in the socket chassis (60).

The housing (70) is mounted on and covers the socket chassis (60).

Mass-producing conventional electronic connectors requires that manufacturers manufacture or procure the USB module (64) separately and mount the USB module (64) in the socket chassis (60). Separately manufacturing or procuring and mounting USB modules (64) make the connectors more expensive. The manufacturers have less profit from making the connectors.

To overcome the shortcomings, the present invention provides a connector to obviate or mitigate the aforementioned problems.

SUMMARY OF THE INVENTION

The primary objective of the present invention is to provide an electronic connector that reduces time to mass-produce electronic connectors and increases profit of making connectors.

The electronic connector socket has an upper RJ-45 hole and a lower USB hole in which at least two USB sockets can be formed. When manufacturers mass-produce the electronic connector sockets, separately making USB socket modules is not necessary anymore. The time to manufacture the electronic connector sockets also can be reduced. The manufacturers are able to increase profit from making the electronic connector sockets.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
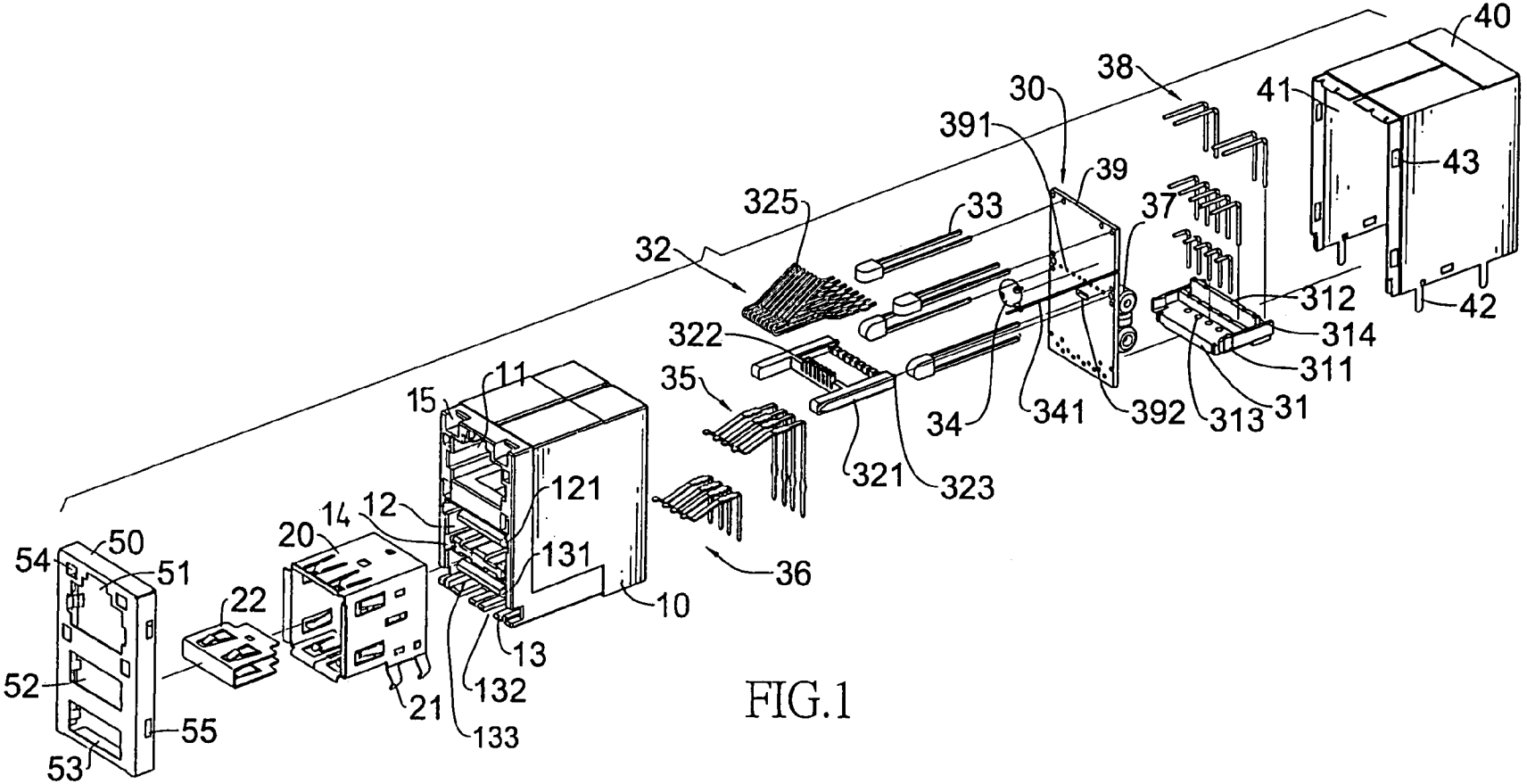
FIG. 1 is an exploded perspective view of a first embodiment of an electronic connector socket in accordance with the present invention.
Figure 3:
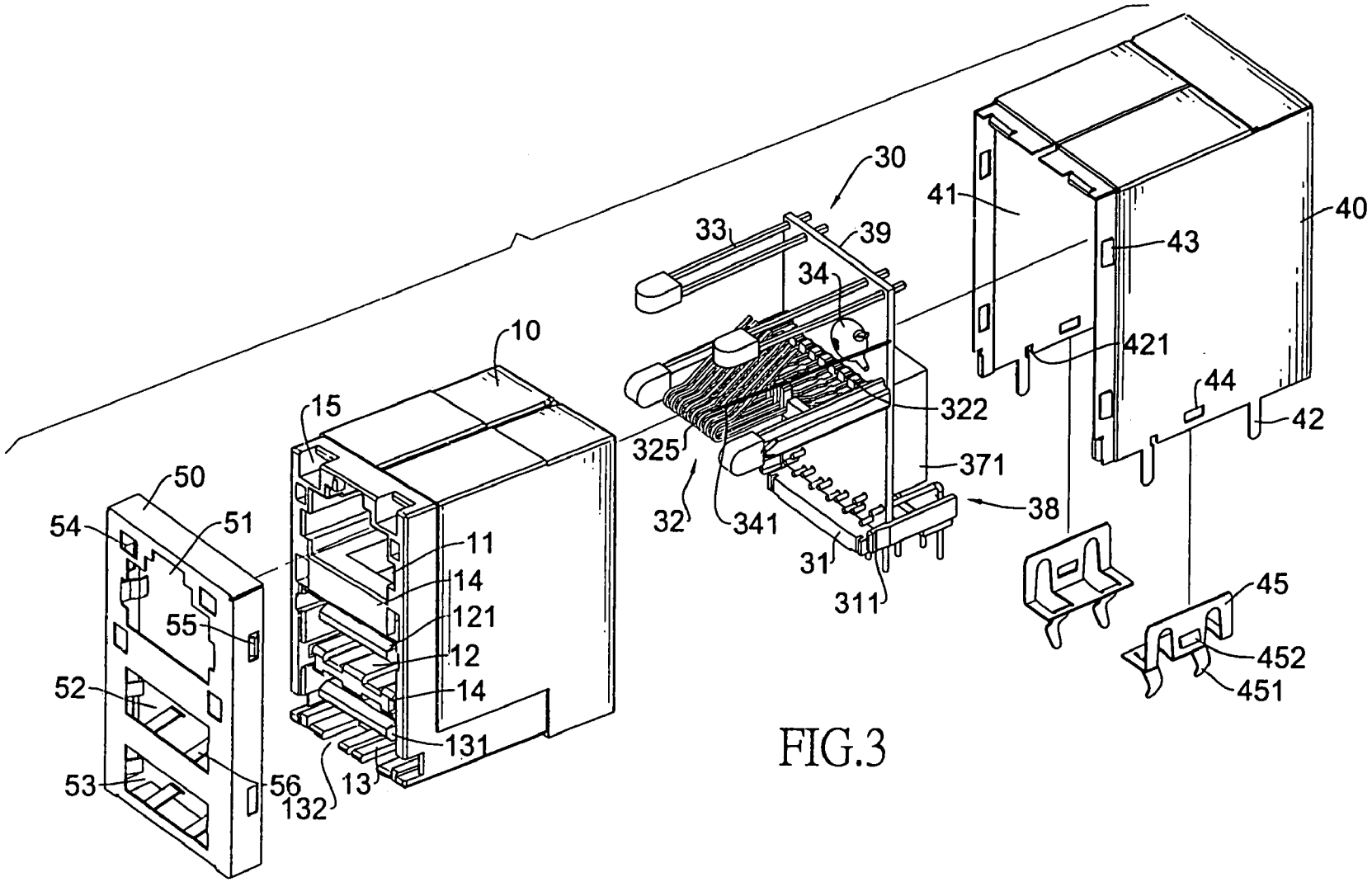
FIG. 3 is an exploded perspective view of a second embodiment of an electronic connector socket in accordance with the present invention.

With reference to FIGS. 1 and 3, an electronic connector socket in accordance with the present invention comprises a socket chassis (10), an RJ-45 contact module (30), multiple sets of USB contacts (35, 36), a housing (40), a front cover (50) and a grounding device.

The socket chassis (10) has a front end, a rear end, a rear recess, an upper RJ-45 hole (11), a lower hole, multiple lamp holes (15) and two L-shaped ground leads (45).

The upper RJ-45 hole (11) is formed through the socket chassis (10) from the front end of the socket chassis (10) and has two inner sides and two slots. The slots are longitudinally formed respectively in the inner sides.

The lower hole is formed through the socket chassis (10) from the front end of the socket chassis (10) and has a top, a bottom, two sides, a front opening, multiple inner casing mounting slots (132), two grounding lead mounting slots (133) and at least one division wall (14).

The inner casing mounting slots (132) are formed longitudinally in the bottom of the lower hole from the front opening.

The grounding lead mounting slots (133) are formed longitudinally in the bottom of the lower hole from the front opening and are formed respectively next to the sides of the lower hole.

The at least one division wall (14) is formed transversely between the sides of the socket chassis (10) between the front and rear ends of the socket chassis (10), protrudes toward the front opening of the lower hole to form a lower USB socket hole (13) and at least one upper USB socket hole (12) and has two side edges, a top surface, a bottom surface, two gaps, two upper grooves and two lower grooves. The gaps are formed between the side edges and the sides of the lower hole. The upper grooves are formed in the top surface and communicate with the front opening in the lower hole. The lower grooves are formed in the bottom surface and communicate with the front opening in the lower hole.

Each USB socket hole (12, 13) has a top, an open front, an inside end, a USB contact bracket (121, 131) and two gaps. Each USB contact bracket (121, 131) is formed between the sides of the lower hole near to the top of the USB socket hole (12, 13), extends toward the open front of the USB socket hole (12, 13) and has two outer edges, a bottom surface, an inner end, two gaps and multiple USB contact slots. The gaps are formed between the sides of the lower hole and the outer edges of the USB contact bracket (121, 131). The USB contact slots are formed longitudinally in the bottom surface of the USB contact brackets (121, 131) from the inner end.

The lamp holes (15) are formed through the socket chassis (10) from the front end to the rear end of the socket (10) and around the upper RJ-45 hole (11).

The inner casing (20) is hollow, is mounted in the lower hole, provides an electrical path to ground and has an open front, an open rear, a top, a bottom, two sides, a front lip, multiple resilient mounting tabs and multiple grounding leads (21). The bottom has two outer edges. The front lip is formed around and protrudes out from the open front. The resilient mounting tabs are formed on and protrude out from the top, bottom and sides of the inner casing and are mounted respectively in the longitudinal grooves in the top, bottom and sides of the lower hole. The grounding leads (21) are formed on the outer edges of the bottom of the socket chassis (10) near the open rear, extend down and are mounted in the grounding lead mounting slots (133) in bottom of the lower hole.

The RJ-45 contact module (30) is mounted in the rear recess of the socket chassis (10), extends into the upper RJ-45 hole (11) and has a base (31), a circuit board (39), an RJ-45 contact assembly (32) and multiple light emitting diodes (LEDs) (33). The base (31) is mounted in the rear recess of the socket chassis (10) and has two sides, a top, two clips (311), two brackets (312) and multiple pin holes (313). The clips (311) are formed respectively on the sides of the base (31) and engage the lower USB socket hole (13) in the socket chassis (10) to attach the base (31) to the socket chassis (10). Each bracket (312) is formed transversely on and protrudes up from the top of the base (31) and has a top edge and multiple slots (314). The slots (314) are formed respectively on the top edges of the brackets (312). The pin holes (313) are formed through the base (31).

The circuit board (39) is attached to the base (31) and has multiple pin holes (391), a position hole (392), a front surface, a rear surface, a bottom, a capacitor (34), multiple filters (37), an bobbin (371) and multiple contact pins (38).

The pin holes (391) and position hole (392) are formed through the circuit board (39).

The capacitor (34) is mounted on the front side of the circuit board (39).

Figure 8:
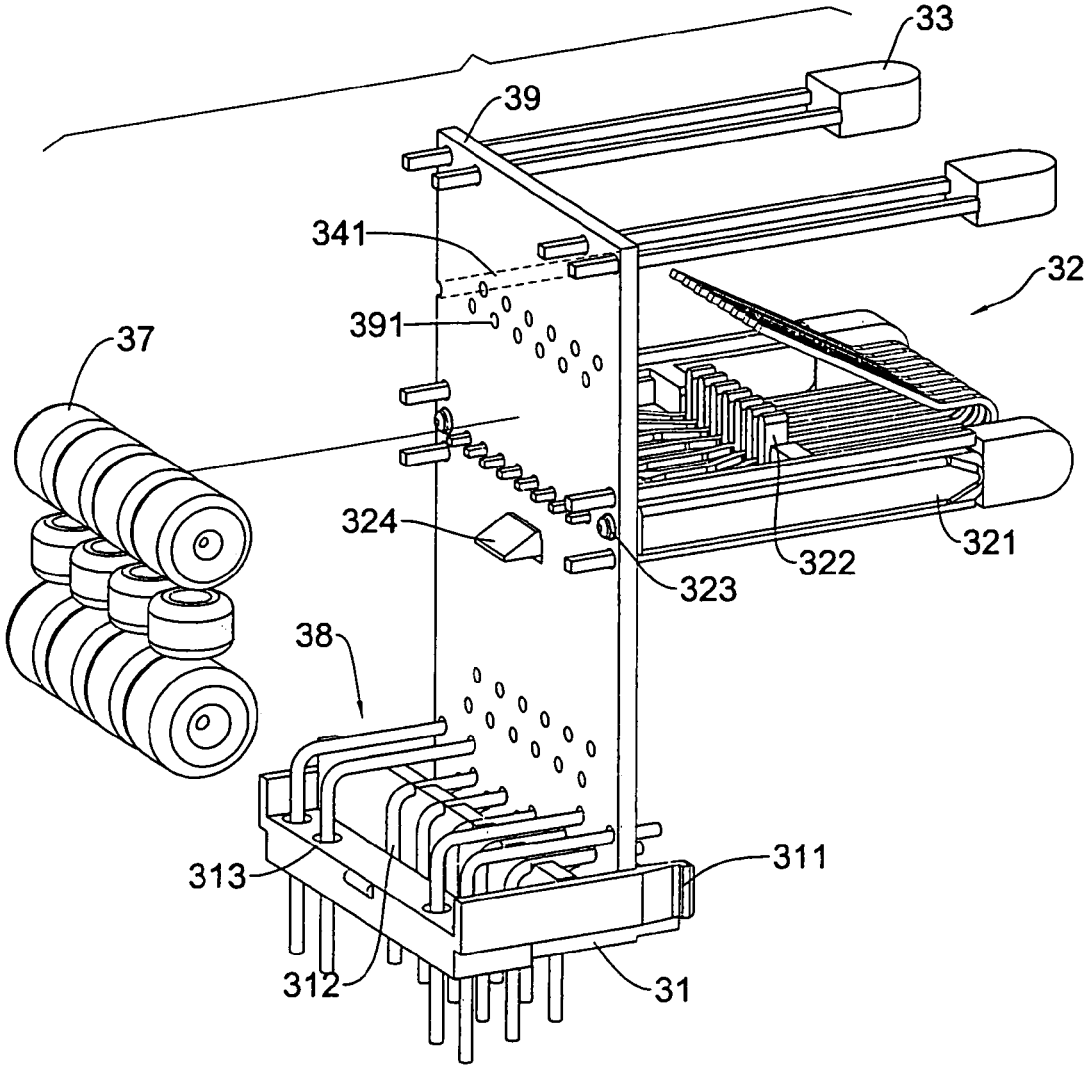
FIG. 8 is a perspective view of an RJ-45 socket module in FIG. 1.

The filters (37) securely mounted on the rear side of the circuit board (30) and have multiple leads. With further reference to FIG. 8, the filters (37) may be attached directly to the circuit board (39) with the leads mounted in the pin holes (391) in the circuit board (39).

Figure 9:
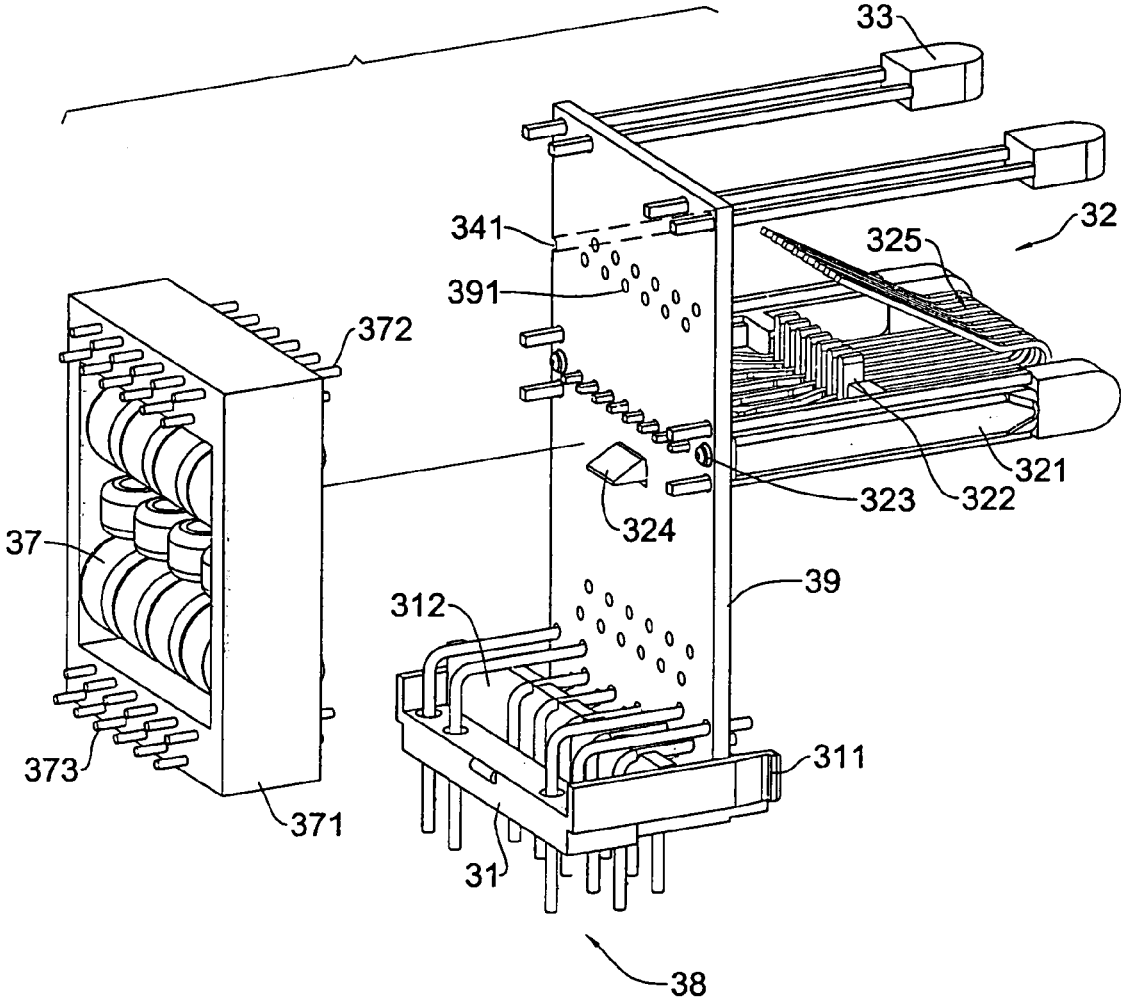
FIG. 9 is a perspective view of an RJ-45 socket module with a filter module in FIG. 3.
Figure 10:
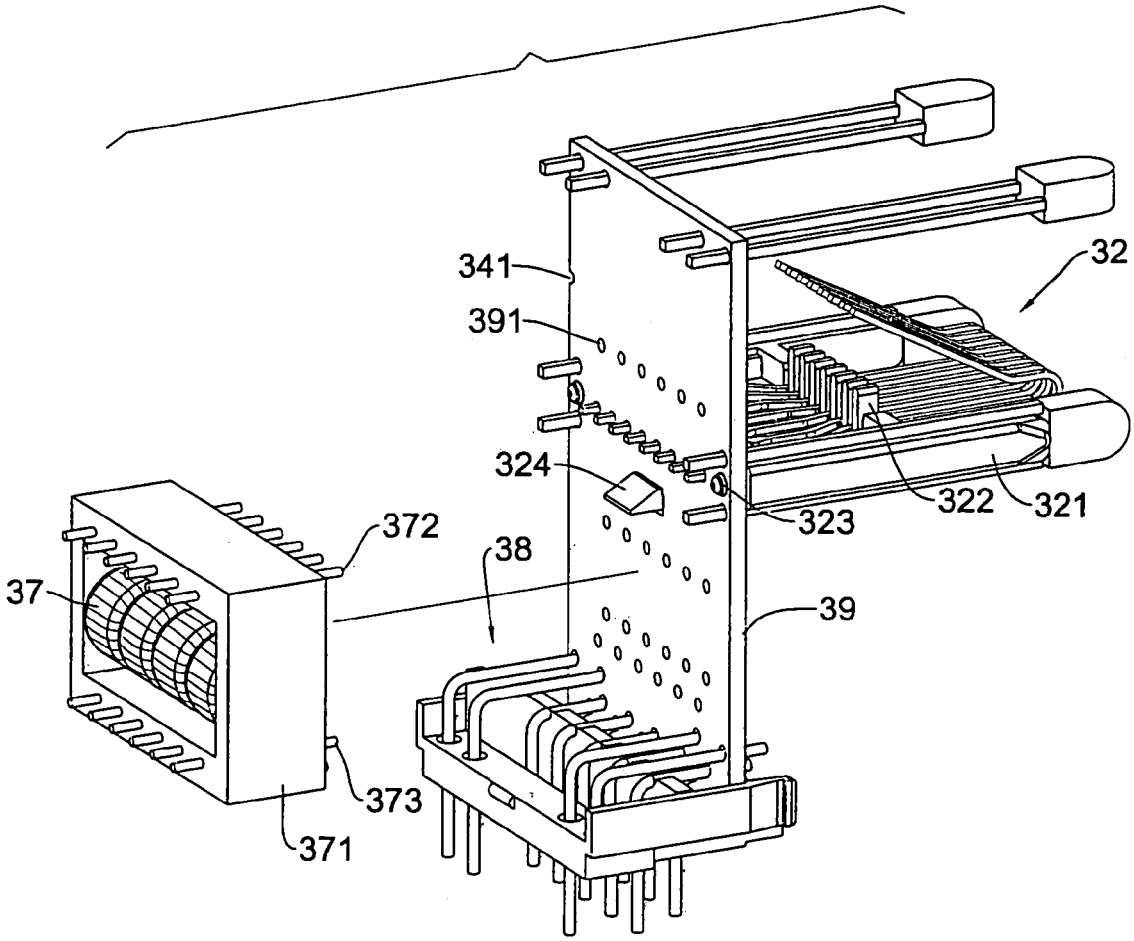
FIG. 10 is a perspective view of the RJ-45 socket module with another filter module.
Figure 11:
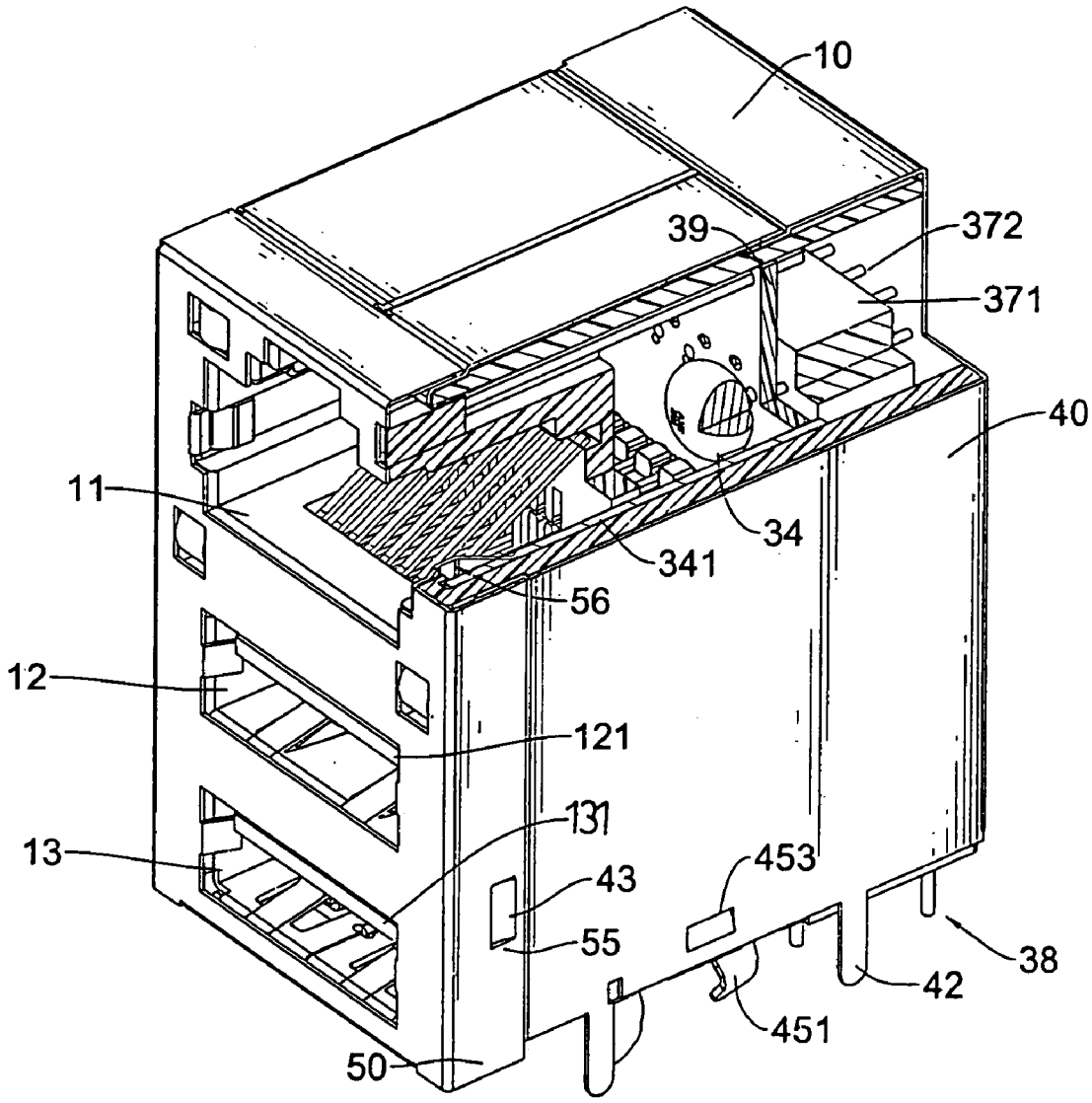
FIG. 11 is a perspective view in partial section of the electronic connector socket in FIG. 3.
Figure 12:
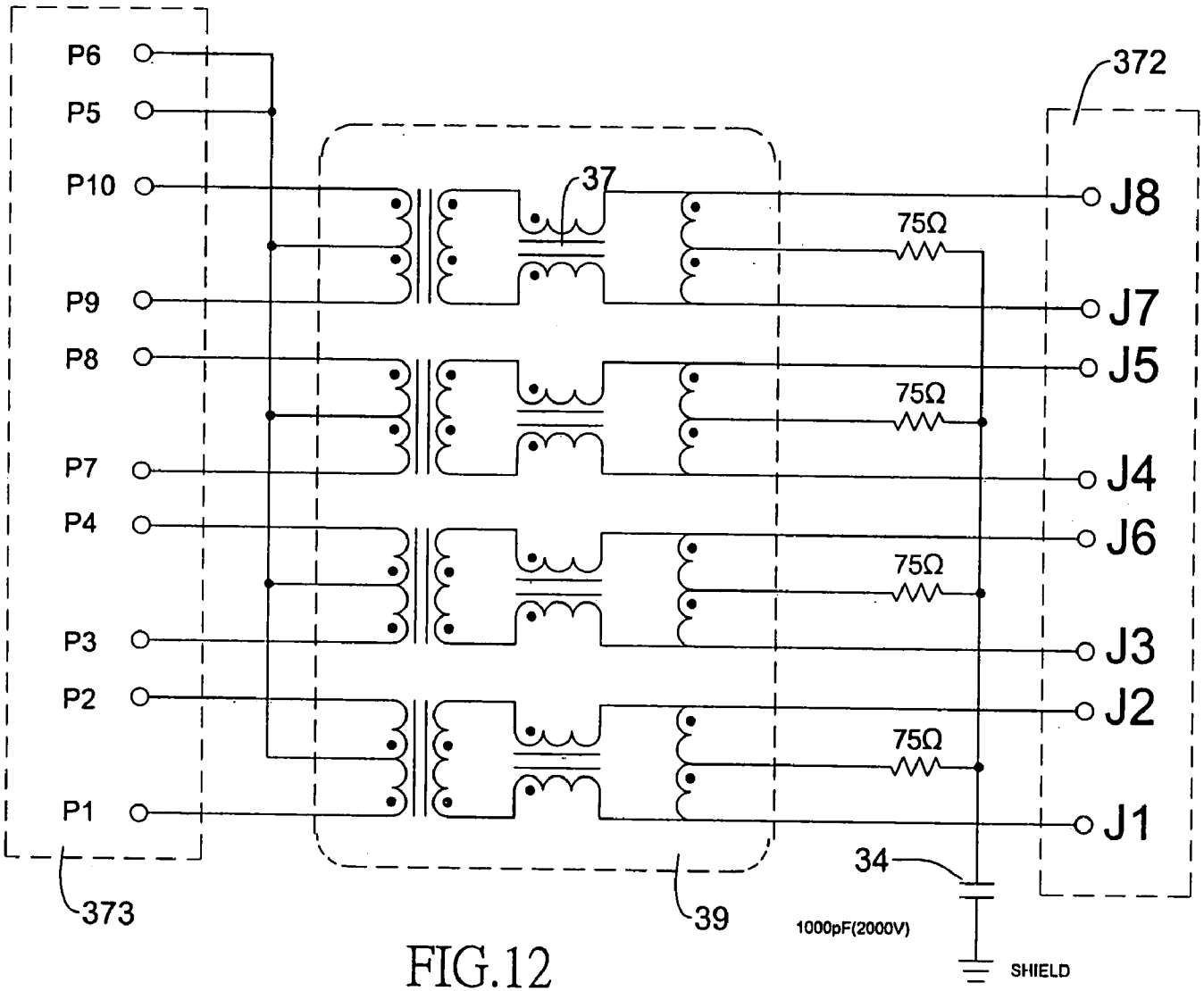
FIG. 12 is a circuit diagram of a first embodiment of a filter module.
Figure 13:
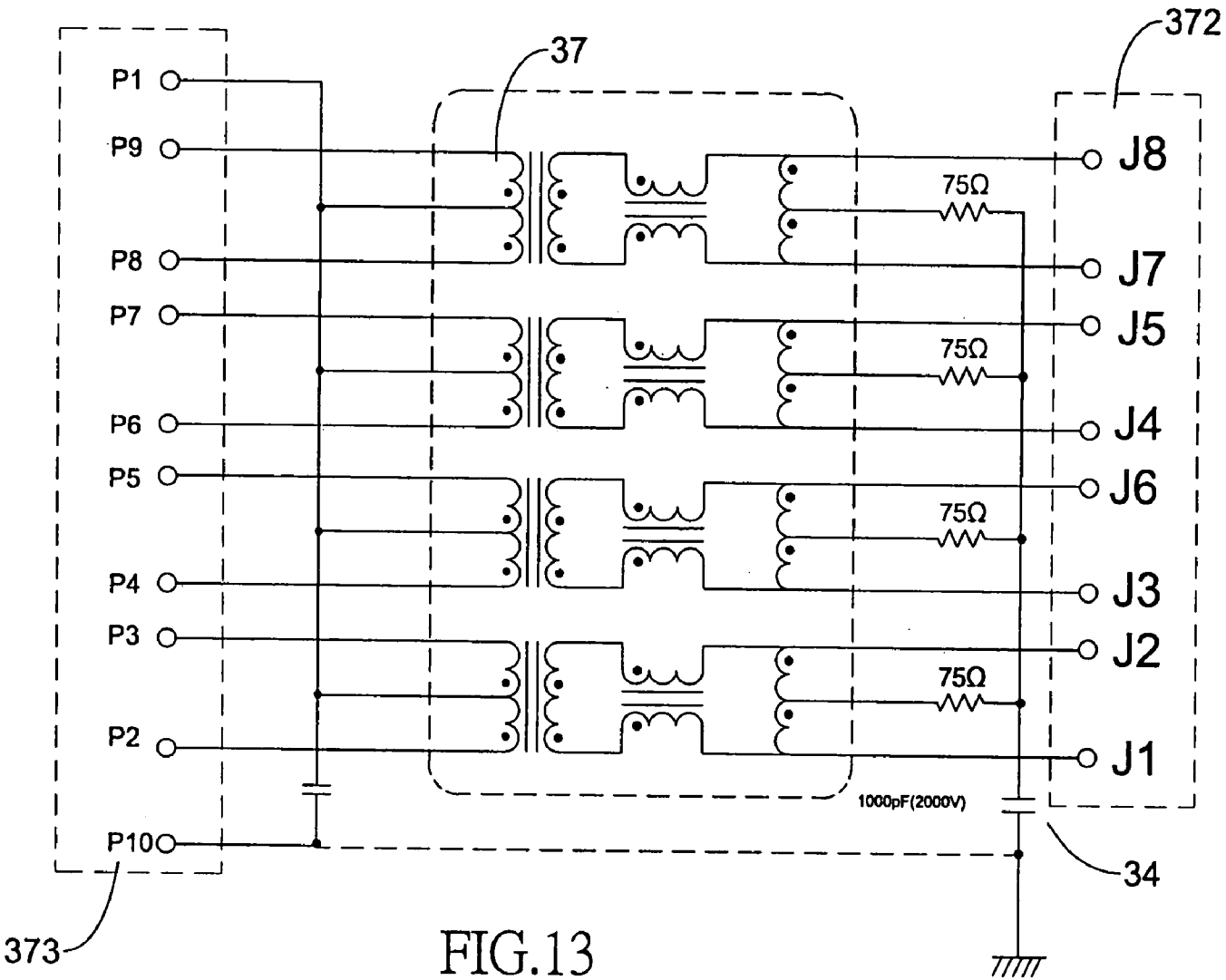
FIG. 13 is a circuit diagram of a second embodiment of a filter module.
Figure 14:
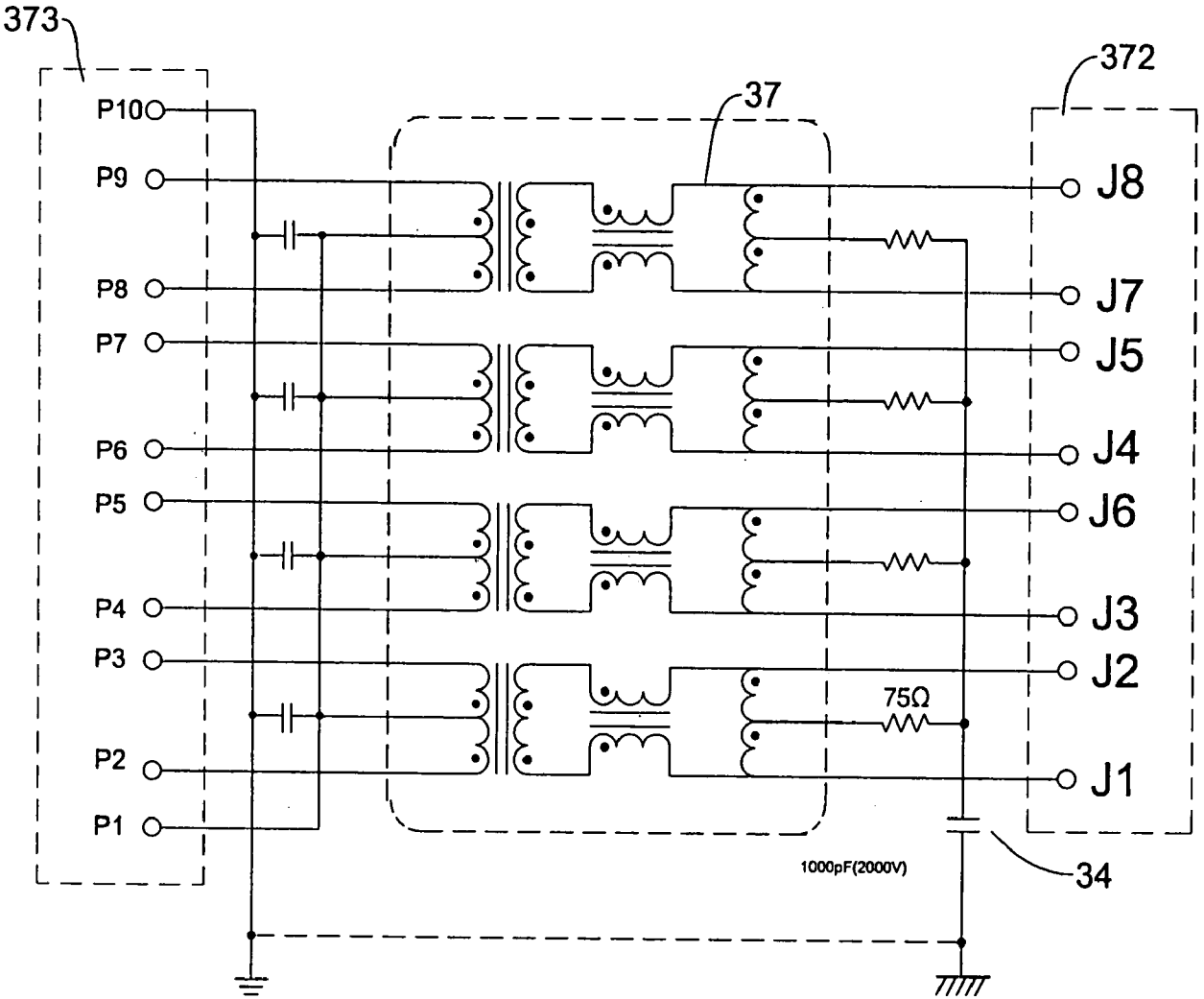
FIG. 14 is a circuit diagram of a third embodiment of a filter module.
Figure 15:
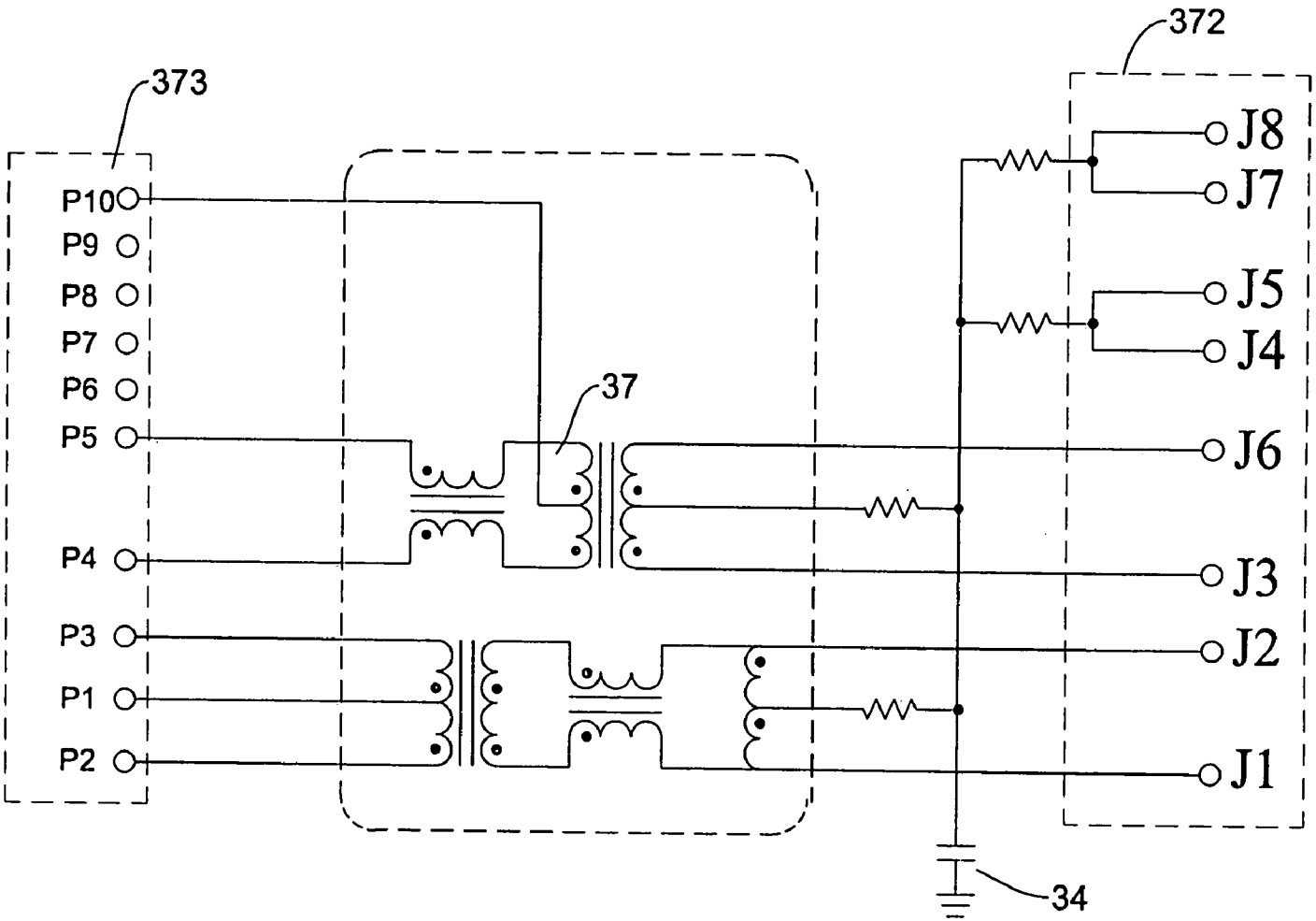
FIG. 15 is a circuit diagram of a fourth embodiment of a filter module.
Figure 16:
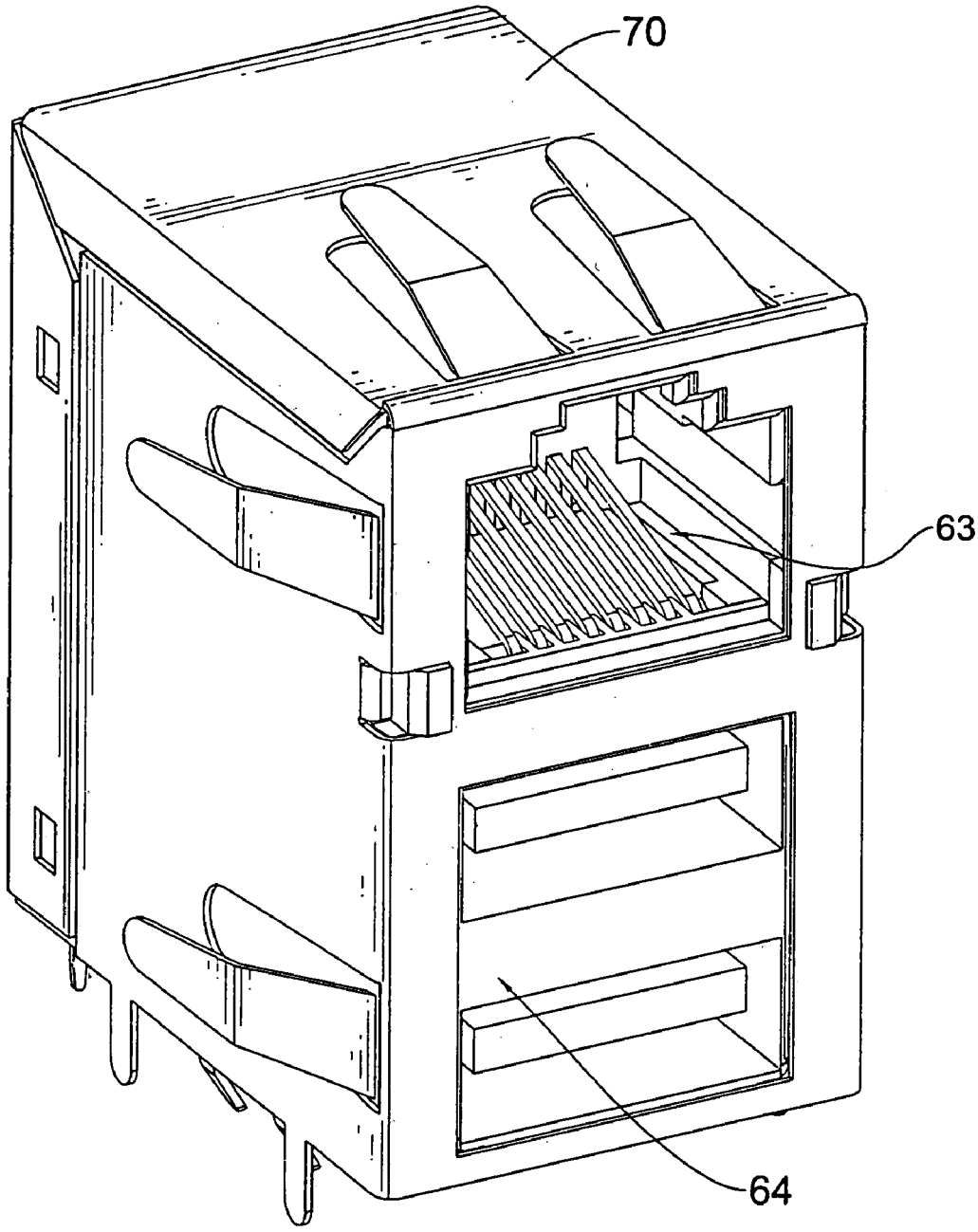
FIG.16 PRIOR ART
FIG. 16 a perspective view of a conventional electronic connector socket in accordance with the prior art.
Figure 17:
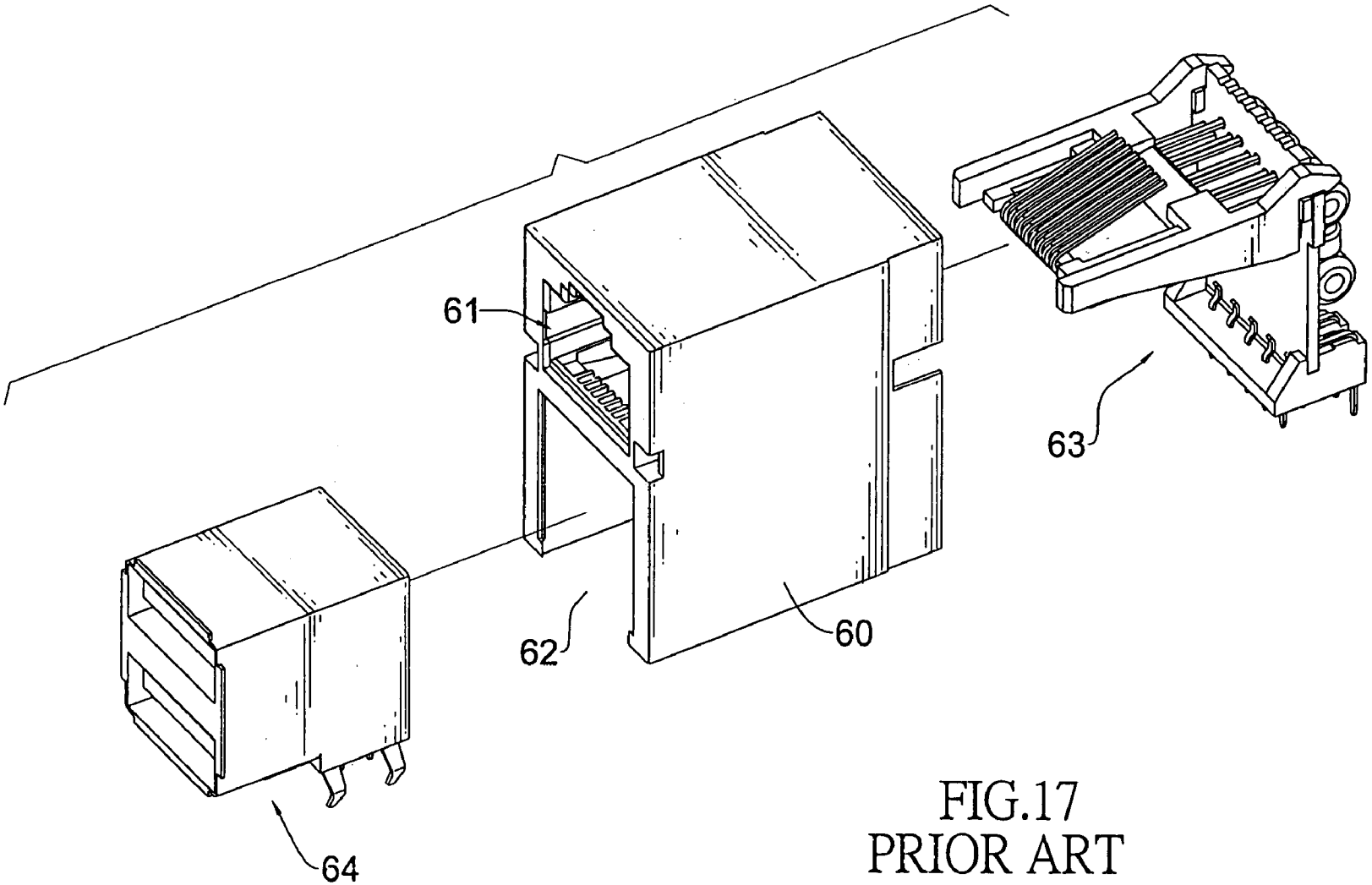
FIG.17 PRIOR ART
FIG. 17 is an exploded perspective view of the electronic connector socket in FIG. 16.

With further reference to FIGS. 9 and 10, the bobbin (371) is securely attached to the rear side of the circuit board (39) and has a top, a bottom, a front face, a rear face, multiple top pins (372), multiple bottom pins (373) and a filter cavity. The top pins (372) are mounted through the top of the bobbin (372) and protrude from the front and rear faces. The top pins (372) extending from the front face are mounted in the pin holes (391) in the circuit board (39). The bottom pins (373) are mounted through the bottom of the bobbin (371) and protrude from the front and rear faces. The bottom pins (373) extending from the front face are mounted in the pin holes (391) in the circuit board (39). The filter cavity is formed in the bobbin (371) and holds the filter (37). The leads from the filters (37) are attached to the top and bottom pins protruding from the rear face of the bobbin (371). With further reference to FIGS. 12 to 15, the filters (37) are connected to ground respectively through resistors and the capacitor (34) on the circuit board (39).

The contact pins (38) are mounted in and protrude through the pin holes (313) in the base (31) and are attached to the circuit board (39). Each contact pin (38) has a proximal end and a distal end. The proximal ends are attached to the pin holes (391) in the circuit board (39). The distal ends protrude from the bottom of the base (31).

Figure 2:
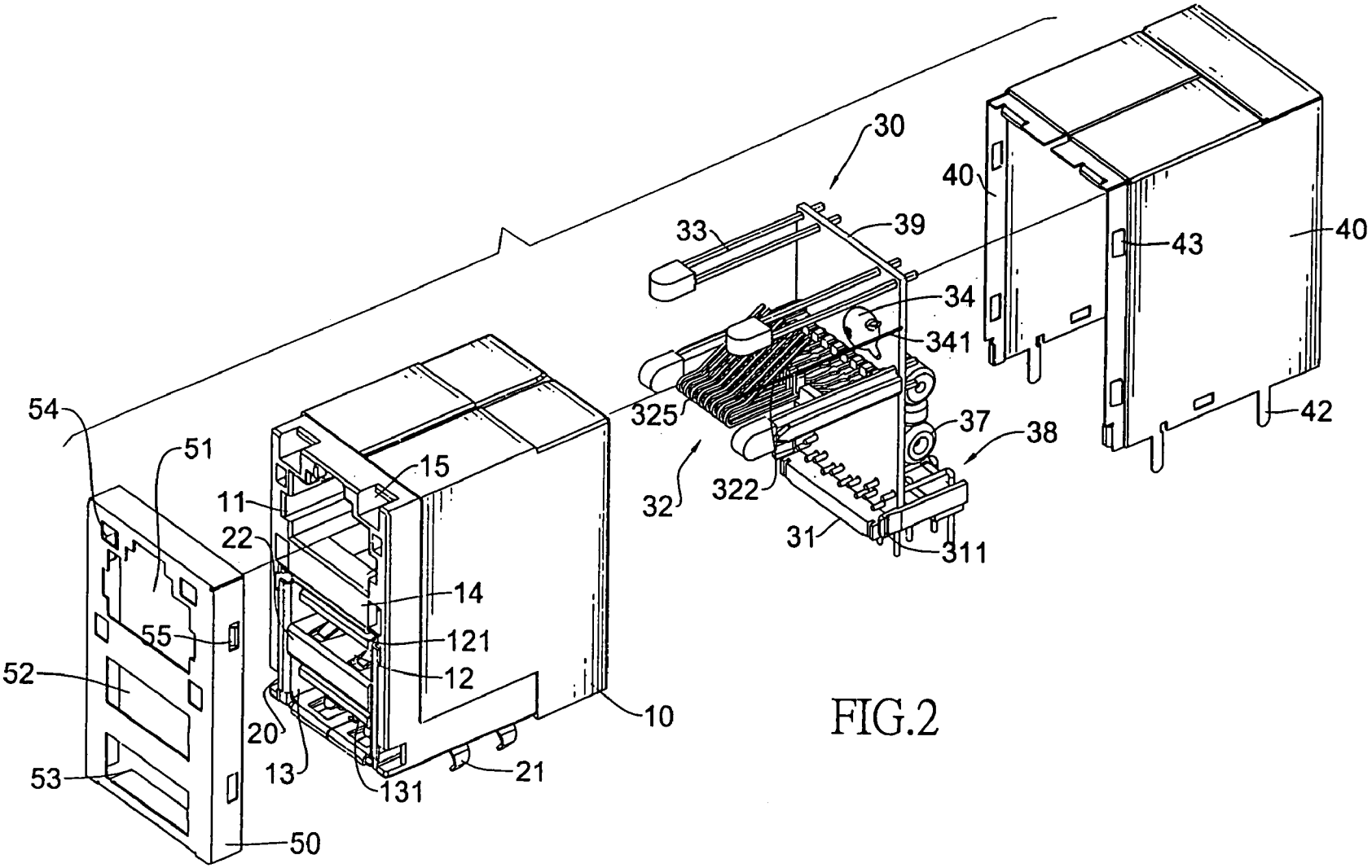
FIG. 2 is an exploded perspective view of the electronic connector socket in FIG. 1.
Figure 5:
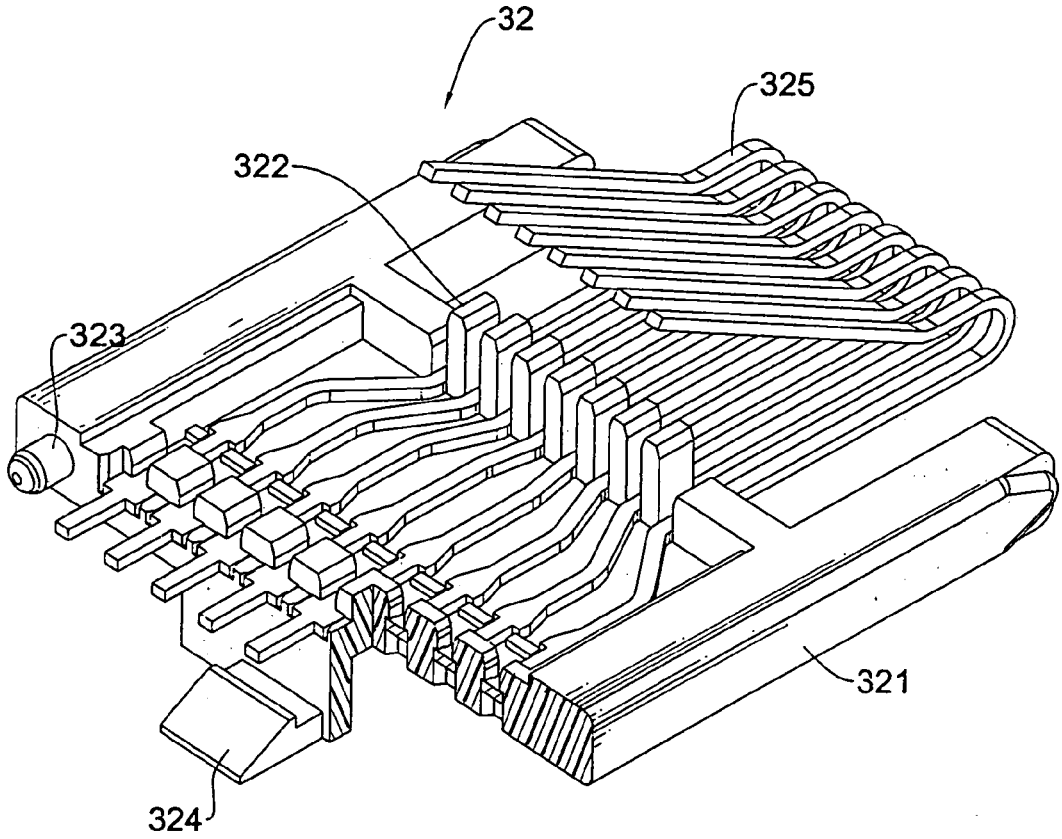
FIG. 5 is a perspective view in partial section of an RJ-45 contact assembly.

With further reference to FIGS. 2 and 5, the RJ-45 contact assembly (32) is connected to front surface of the circuit board (39), extends into the upper RJ-45 hole (11) and has a contact bracket (321) and multiple resilient RJ-45 contacts (325).

The contact bracket (321) is attached to the front surface of the circuit board (39), protrudes into the upper RJ-45 hole (11) and has a rear end, a top surface, a transverse bar, a mounting tab (324) and multiple mounting posts (323). The transverse bar has a top surface and multiple contact slots (322). The contact slots (322) are formed in the top surface of the transverse bar. The mounting tab (324) is formed on and extends out of the rear end of the contact bracket (321) and engages the position hole (392) to attach the contact bracket (321) to the circuit board (39). The multiple mounting posts (323) are formed on and extend out of the rear end of the contact bracket (321) and mounted in the pin holes (391) to hold the contact bracket in position on the circuit board (39).

The resilient RJ-45 contacts (325) are mounted respectively in the pin holes (391) in the circuit board (39) and respectively in the contact slots (322) in the transverse bar of the contact bracket (321).

The LEDs (33) are mounted on the front surface of the circuit board (39) and extend respectively into the lamp holes (15).

Figure 6:
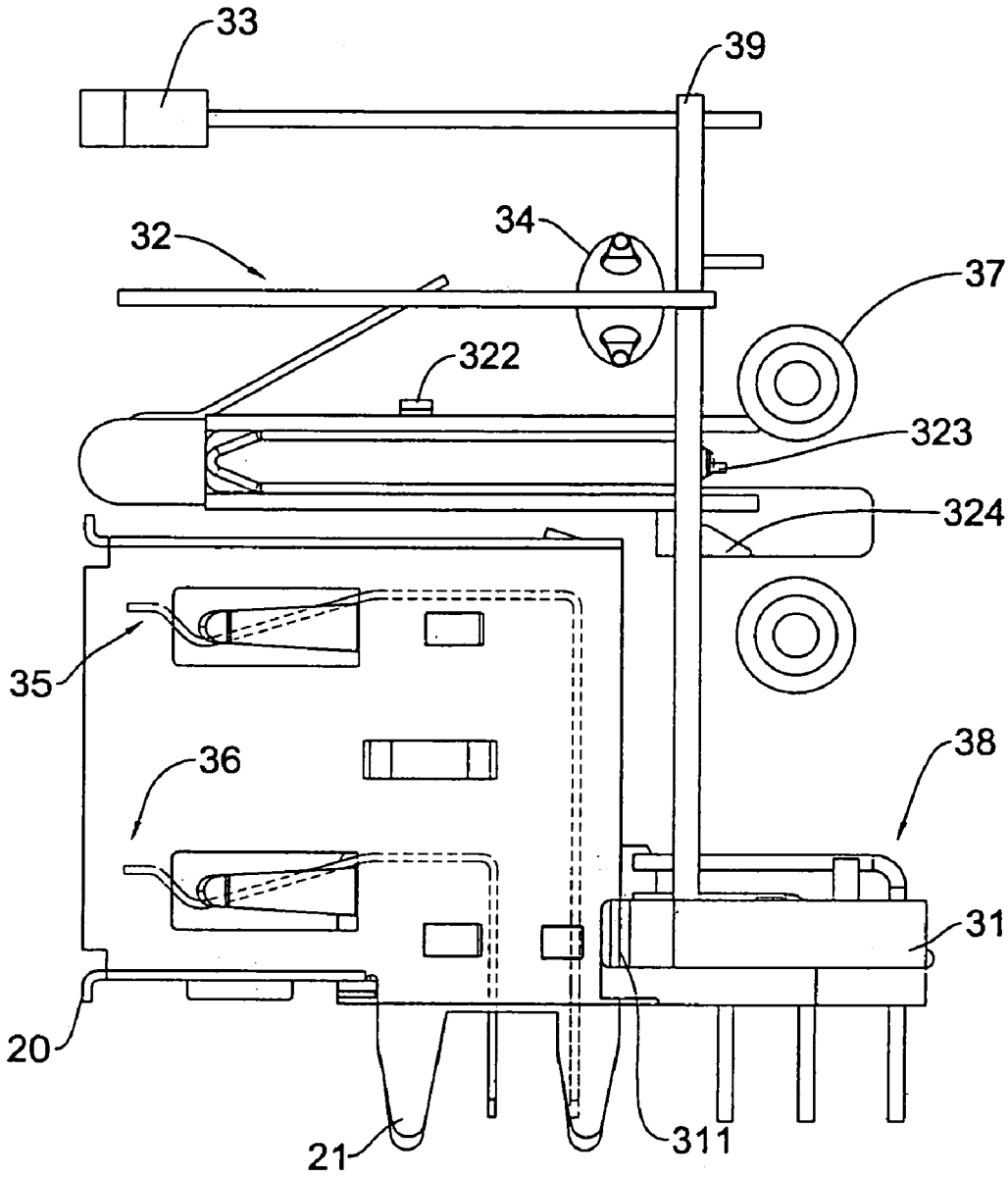
FIG. 6 is a side view of an inner casing with a circuit board in FIG. 1.
Figure 7:
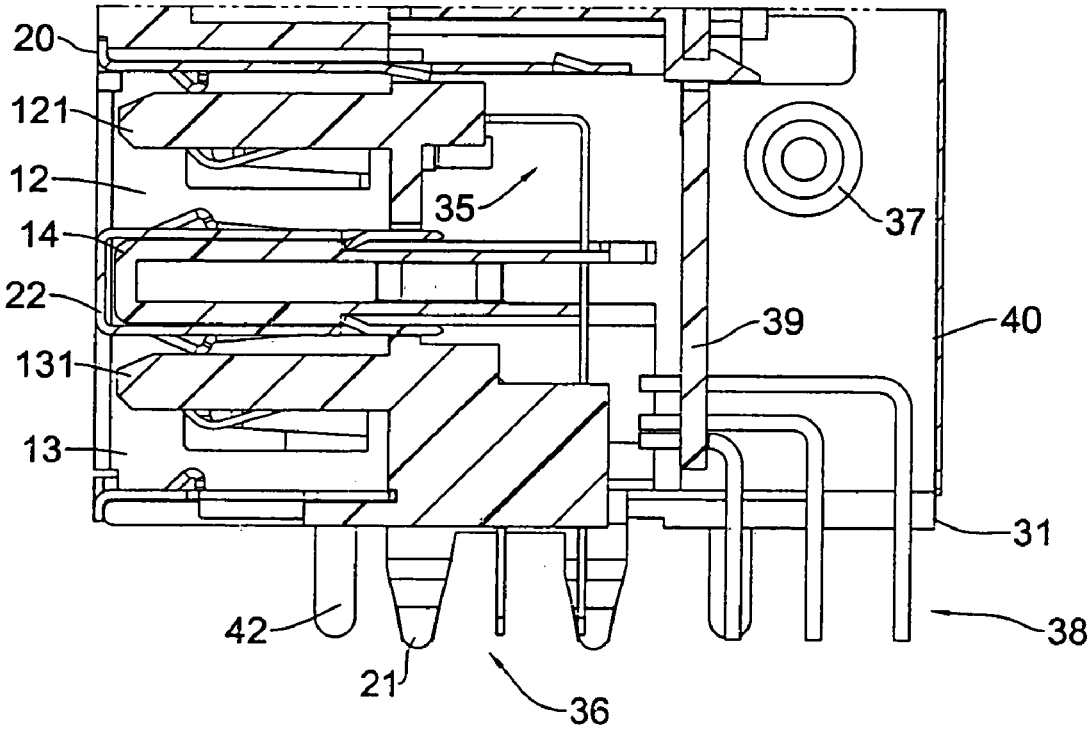
FIG. 7 is a side view in partial section of the inner casing with the circuit board in FIG. 6.

With further reference to FIGS. 6 and 7, the multiple sets of USB contacts (35, 36) are mounted through the bottom of the socket chassis (10), and the USB contacts (35, 36) are mounted respectively in the USB contact slots respectively in the USB contact brackets (121, 131).

The housing (40) is U-shaped, is mounted over the socket chassis (10) and has an open front (41), a lip, multiple cover bosses (43), a bottom edge, multiple legs (42) and two inner side surfaces. The lip is formed on and protrudes longitudinally from the open front (41). The cover bosses (43) are formed on and protrude out from the lip of the housing (40). The legs (42) are formed on and protrude down from the bottom edge of the housing (40).

The front cover (50) is mounted on the lip around the open front (41) of the housing (40) and has a front surface, a rear surface, a longitudinal lip, an RJ-45 opening (51), multiple USB openings (52, 53), multiple LED openings (54) and multiple detents (55).

The longitudinal lip is formed around and protrudes from the rear surface of the front cover (50).

The RJ-45 opening (51), the USB openings (52, 53) and the LED openings (54) are formed through the front surface of the front cover (50) and correspond respectively to the upper RJ-45 hole (11), the USB socket holes (12, 13) and the lamp holes (15) in the socket chassis (10).

The detents (55) are formed through the longitudinal lip on the front cover (50) and attach respectively to the cover bosses (43) on the lip around the open front (41) of the housing (40) to securely attach the front cover (50) to the housing (40).

In a first embodiment, with reference to FIGS. 1 and 2, the grounding device comprises an inner casing (20) and at least one grounding clamp (22). The at least one grounding clamp (22) is U-shaped, is mounted in the upper and lower grooves on the division wall (14) and is electrically connected to the USB contacts (35,36) to provide a path to ground for plugs mounted in the USB sockets.

Figure 4:
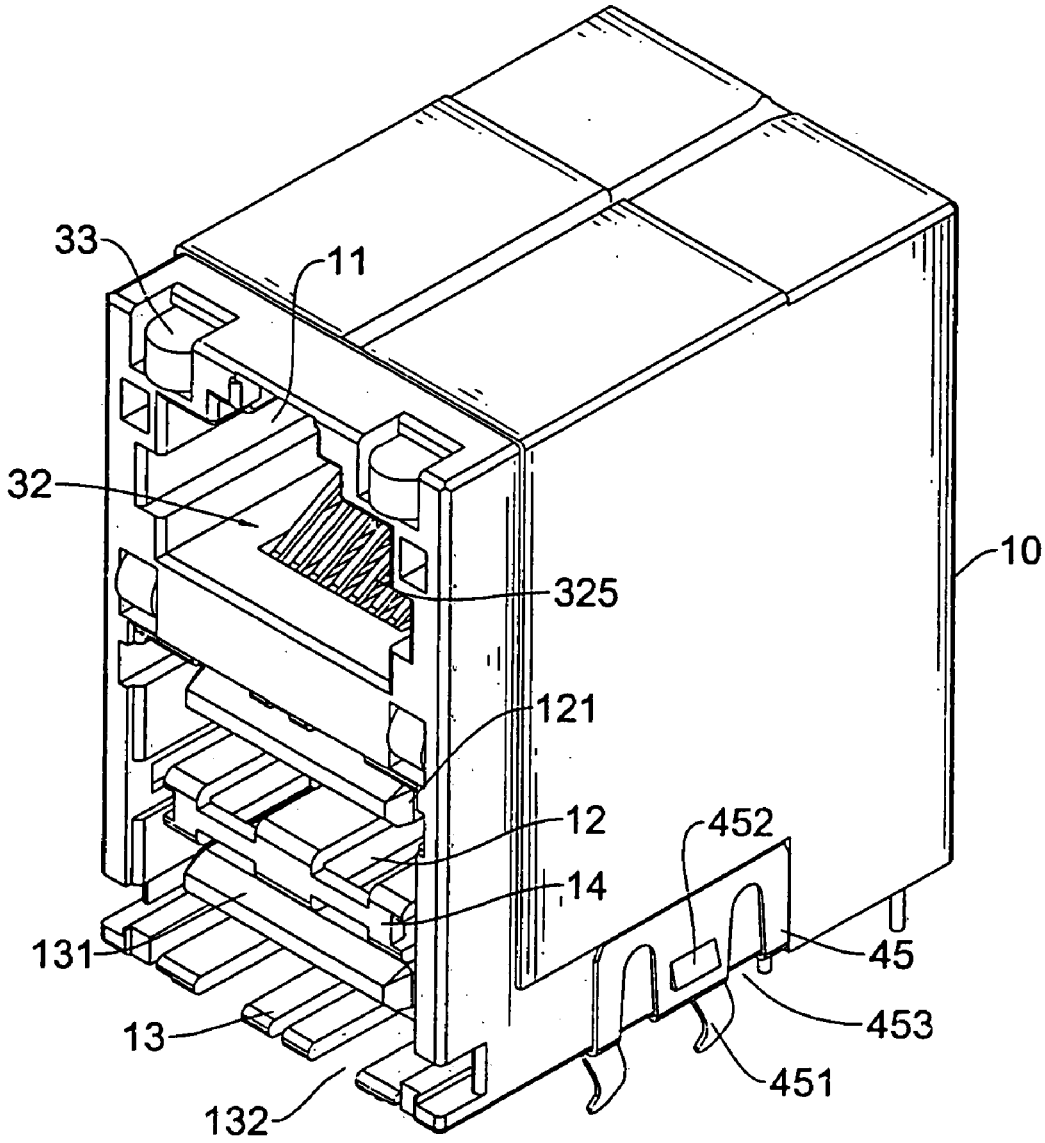
FIG. 4 is a perspective view of the electronic connector socket in FIG. 3 without a housing cover.

In a second embodiment, with further reference to FIGS. 3 and 4, the grounding device comprises an electrical conductor (341), multiple tabs (56) and two L-shaped grounding leads (45).

The electrical conductor (341) is mounted on the front side of the circuit board (39) and extends into the recess in the upper RJ-45 hole (11) in the socket chassis (10). The electrical conductor (341) may be a leg of the capacitor (34) or a metal wire.

The tabs (56) are formed on the front cover (50) around the RJ-45 opening (51) and the USB openings (52, 53) and protrude respectively into the upper RJ-45 hole (11) and the USB socket holes (12, 13). One of the tabs (56) makes electrical contact with the electrical conductor (341) mounted in the longitudinal recess in the upper RJ-45 hole to ground the front cover (50).

The L-shaped ground leads (45) are mounted at the bottom edge of socket chassis (10) and each L-shaped ground lead (45) has a vertical side, a horizontal side, a bend, two legs (451), at least one hole and a mounting boss (452). The bend is formed where the vertical and horizontal sides join. The legs (451) are formed on the L-shaped ground lead (45) at the bend and extend down. The hole is formed through the L-shaped ground lead (45). The mounting boss (452) is formed on and protrudes out from the vertical side of the L-shaped ground lead (45).

In addition, the housing further has at least two nubs (421) and two mounting holes (44). The nubs (421) are formed respectively on and protrude in from the inner side surfaces near the bottom edge and engage the hole in the L-shaped grounding leads (45) to hold the L-shaped grounding leads (45) in place. The mounting holes (44) are formed respectively through the inner side surfaces of the housing (40), correspond to each other and engage the mounting bosses (452) on the L-shaped grounding leads (45) to hold the L-shaped grounding leads (45) in place between the socket chassis (10) and the housing (40).

With the engagement between the housing (40) and the front cover (50), the tabs (56) are electrically connected tot he L-shaped grounding leads (45) to provide a path to ground.

When manufacturers mass-produce the electronic connector sockets, separately making USB modules does not have to be done anymore. Time to make the electronic connector sockets also can be reduced. The manufacturers are able to increase profit from making the electronic connector sockets.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. An electronic connector socket comprising
- a socket chassis having
- a front end;
- a rear end;
- a rear recess;
- an upper RJ-45 hole formed through the socket chassis from the front end of the socket chassis and having
  - two inner sides; and
  - two slots longitudinally formed respectively in the inner sides; and
- a lower hole formed through the socket chassis from the front end of the socket chassis and having
  - a top;
  - a bottom;
  - two sides;
  - a front opening;
  - at least one division wall formed transversely between the sides of the socket chassis between the front and rear ends of the socket chassis, protruding toward the front opening of the lower hole to form a lower USB socket hole and at least one upper USB socket hole and each one having
    - two side edges;
    - a top surface;
    - a bottom surface;
    - two upper grooves formed in the top surface and communicating with the front opening in the lower hole; and
    - two lower grooves formed in the bottom surface and communicating with the front opening in the lower hole; and
    - each USB socket hole having
      - a top;
      - an open front;
      - an inside end;
      - a USB contact bracket formed between the sides of the lower hole near to the top of the USB socket hole, extending toward the open front of the USB socket hole and having;
        - two outer edges;
        - a bottom surface;
        - an inner end; and
    - multiple USB contact slots formed longitudinally in the bottom surface of the USB contact brackets from the inner end;
- an RJ-45 contact module mounted in the rear recess of the socket chassis, extending into the upper RJ-45 hole and having
  - a base mounted in the rear recess of the socket chassis and having
    - two sides;
    - a top;
    - two clips formed respectively on the sides of the base and engaging the lower USB socket hole in the socket chassis to attach the base to the socket chassis;
    - two brackets, each bracket formed transversely on and protruding up from top of the base and having
      - a top edge; and
      - multiple slots formed respectively on the top edges of the brackets; and
    - multiple pin holes formed through the base;

a circuit board attached to the base and having
multiple pin holes formed through the circuit board;
a position hole formed through the circuit board;
a front surface;
a rear surface;
a bottom;
a capacitor mounted on the front side of the circuit board;
multiple filters securely mounted on the rear surface of the circuit board; and
multiple contact pins mounted in and protruding through the pin holes in the base and attached to the circuit board, each contact pin having
a proximal end attached to the pin holes in the circuit board; and
a distal end protruding from the bottom of the base;
an RJ-45 contact assembly connected to front surface of the circuit board, extending into the upper RJ-45 hole and having
a contact bracket attached to the front surface of the circuit board, protruding into the upper RJ-45 hole and having
a rear end;
a top surface;
a transverse bar having
a top surface; and
multiple contact slots formed in the top surface of the transverse bar;
a mounting tab formed on and extending out of the rear end of the contact bracket and engaging the position hole to attach the contact bracket to the circuit board; and
multiple mounting posts mounted in the pin holes to hold the contact bracket in position on the circuit board; and
multiple resilient RJ-45 contacts mounted respectively in the pin holes in the circuit board and respectively in the contact slots in the transverse bar of the contact bracket;
multiple sets of USB contacts mounted through the bottom of the socket chassis, and the USB contacts mounted respectively in the USB contact slots respectively in the USB contact brackets;
a housing being U-shaped, mounted over the socket chassis and having
an open front;
a lip formed on and protrudes longitudinally from the open front;
multiple cover bosses;
a bottom edge;
multiple legs formed on and protrude out from the lip of the housing; and
two inner side surfaces;
a front cover mounted on the lip around the open front of the housing and having
a front surface;
a rear surface;
a longitudinal lip formed around and protrudes from the rear surface of the front cover;
an RJ-45 opening formed through the front surface of the front cover and correspond respectively to the upper RJ-45 hole;
multiple USB openings formed through the front surface of the front cover and correspond respectively to the USB socket holes; and
multiple detents formed through the longitudinal lip on the front cover and attaching respectively to the cover bosses on the lip around the open front of the housing to securely attach the front cover to the housing; and
a grounding device electrically connected to the USB contacts to provide an electronic ground to the electronic connector socket.

2. The electronic connector socket as claimed in claim 1, wherein
the lower hole of the socket chassis further has inner casing mounting slots formed longitudinally in the bottom of the lower hole from the front opening and multiple grounding lead mounting slots formed longitudinally in the bottom of the lower hole from the front opening and formed respectively next to the sides of the lower hole;
the division wall further has two gaps formed between the side edges and the sides of the lower hole; and
the USB contact bracket further has two gaps formed between the sides of the lower hole and the outer edges of the USB contact bracket;
wherein the grounding device comprises
an inner casing being hollow, mounted in the inner casing mounting slots of the lower hole and having an open front, an open rear, a top, a bottom, two sides, a front lip formed around and protruding out of the open front, and multiple resilient mounting tabs formed on and protruding out of the top, bottom and sides of the inner casing and mounted respectively in the longitudinal grooves in the top bottom and sides of the lower hole; and
at least one grounding clamp being U-shaped, mounted in the upper and lower grooves on the division wall and electrically connected to the USB contacts.

3. The electronic connector socket as claimed in claim 1, wherein the grounding device comprises
an electrical conductor mounted on the front side of the circuit board and extends into the recess in the upper RJ-45 hole in the socket chassis;
multiple tabs formed on the front cover around the RJ-45 opening and the USB openings and protruding respectively into the upper RJ-45 hole and the USB socket holes, one of the tabs making electrical contact with the electrical conductor mounted in the longitudinal recess in the upper RJ-45 hole to ground the front cover; and
two L-shaped mounted at the bottom edge of socket chassis, electrically connected to the tabs on the front cover and each L-shaped ground lead having
a vertical side;
a horizontal side;
a bend formed where the vertical and horizontal sides join;
two legs formed on the L-shaped ground lead at the bend and extending down;
at least one hole formed through the L-shaped ground lead; and
a mounting boss formed on and protrudes out from the vertical side of the L-shaped ground lead.

4. The electronic connector socket as claimed in claim 2, wherein the circuit board further has a bobbin securely attached to the rear surface of the circuit board and having
a top;
a bottom;
a front face;
a rear face;
multiple top pins mounted through the top of the bobbin and protruding from the front and rear faces, and the pins extending from the front face are mounted in the pin holes in the circuit board, multiple bottom pins mounted through the bottom of the bobbin and protruding from the front and rear faces, and the pins extending from the front face are mounted in the pin holes in the circuit board; and a filter cavity formed in the bobbin and holding the filters.

5. The electronic connector socket as claimed in claim 3, wherein the circuit board further has a bobbin securely attached to the rear surface of the circuit board and having a top;

a bottom;

a front face;

a rear face;

multiple top pins mounted through the top of the bobbin and protruding from the front and rear faces, and the pins extending from the front face are mounted in the pin holes in the circuit board;

multiple bottom pins mounted through the bottom of the bobbin and protruding from the front and rear faces, and the pins extending from the front face are mounted in the pin holes in the circuit board; and a filter cavity formed in the bobbin and holding the filters.

6. The electronic connector socket as claimed in claim 4, wherein the socket chassis further has multiple lamp holes formed through the socket chassis from the front end to the rear end of the socket and around the upper RJ-45 hole;

the circuit board further has multiple light emitting diodes mounted on the front surface of the circuit board and extending respectively into the lamp holes; and the front cover has multiple LED openings formed through the front surface of the front cover and corresponding respectively to the lamp holes in the socket chassis.

7. The electronic connector socket as claimed in claim 5, wherein the socket chassis further has multiple lamp holes formed through the socket chassis from the front end to the rear end of the socket and around the upper RJ-45 hole;

the circuit board further has multiple light emitting diodes mounted on the front surface of the circuit board and extending respectively into the lamp holes; and the front cover has multiple LED openings formed through the front surface of the front cover and corresponding respectively to the lamp holes in the socket chassis.

8. The electronic connector socket as claimed in claim 7, wherein each L-shaped ground lead further has a mounting boss formed on and protrudes out from the vertical side of the L-shaped ground lead; and the housing further has two mounting holes formed respectively through the inner side surfaces of the housing, corresponding to each other and respectively engaging the mounting bosses on the L-shaped grounding leads to hold the L-shaped grounding leads in place between the socket chassis and the housing.

* * * * *